United States Patent [19]

Nishihata et al.

[11] Patent Number: 4,527,698

[45] Date of Patent: Jul. 9, 1985

[54] METHOD OF AND APPARATUS FOR SUPPORTING ROPE OF CRANE HAVING ARTICULATING STRUCTURE

[75] Inventors: Kouji Nishihata; Ichiro Nakazima; Mituo Hirata, all of Kudamatsu, Japan

[73] Assignee: Hitachi, Ltd., Tokyo, Japan

[21] Appl. No.: 493,512

[22] Filed: May 11, 1983

[30] Foreign Application Priority Data

May 12, 1982 [JP] Japan ..... 57-78203

[51] Int. Cl.[3] ..... B66C 23/82

[52] U.S. Cl. ..... 212/187; 212/218; 212/262

[58] Field of Search ..... 212/187, 188, 196–198, 212/205, 211, 218, 224, 237, 238, 239, 255, 260–262

[56] References Cited

U.S. PATENT DOCUMENTS

| | | | |
|---|---|---|---|
| 1,497,686 | 6/1924 | Johnson | 212/197 |
| 3,325,018 | 6/1967 | Wright | 212/187 |
| 3,722,705 | 3/1973 | Gould | 212/198 |
| 4,403,704 | 9/1983 | Makino | 212/262 |

FOREIGN PATENT DOCUMENTS

| | | | |
|---|---|---|---|
| 49-764 | 6/1973 | Japan | 212/205 |
| 206047 | 2/1968 | U.S.S.R. | 212/239 |

*Primary Examiner*—Trygve M. Blix
*Assistant Examiner*—Stephen P. Avila
*Attorney, Agent, or Firm*—Antonelli, Terry & Wands

[57] ABSTRACT

A crane has an elevation structure foldable at its intermediate portion, a rope extended along the structure and a rope support for supporting the rope. When the structure is folded and elevated, the rope support is moved to and held at a position near the point of folding of the structure. After the completion of straightening of the structure, the rope support is held at a position adjacent to the extreme end of the structure. A rope supporting apparatus for realizing this method includes an arrangement for mounting the rope support for movement along the structure, and a shifting driving mechanism mounted on the rope support and adapted to drive the rope support along the length of the structure.

7 Claims, 16 Drawing Figures

METHOD OF AND APPARATUS FOR SUPPORTING ROPE OF CRANE HAVING ARTICULATING STRUCTURE

BACKGROUND OF THE INVENTION

1. Field of the Invention

The present invention relates to a method of and apparatus for supporting a rope of a crane of the type having an articulating structure.

2. Description of the Prior Art

Conventional cranes such as bridge cranes have a structure carried by tall legs or supports. The structure is usually divided into three sections: namely, an end boom section, a base boom section and a main girder section. The end boom section and the base boom section in combination constitute an elevation structure. These sections are pivotally connected in series at their opposing ends by means of shafts, so that each girder section can pivot relatively to the adjacent one or ones. A hoisting rope is extended along the structure. A trolley having a hoisting tackle suspended from the hoisting rope is adapted to run along the structure from one section to another. This type of crane is shown, for example, in the specification of U.S. Pat. No. 3,325,018. When the operation of the crane is suspended, the crane is made to rest with its elevation structure folded such that the end boom section is extended horizontally while the base boom section is made to stand upright. As the elevation structure of the crane is folded in this manner, the hoisting rope is slacked largely and hung from the main girder section and the end boom section dangerously. In order to avoid this danger, it is conceiveable to support the hoisting rope by a suitable rope support so as not to permit the rope to hang. Attaching of such rope support, however, may form an obstacle which impairs linear and smooth running of the cargo trolley over the entire length of the structure.

Another solution is disclosed in, for example, Japanese Utility Model Laid-Open No. 49764/1973. In this prior art, a trolley adapted to run on the girder is connected through a rope to a rope support which is also adapted to run on the girder. In operation, the trolley runs towing the rope support, while paying off or taking up the rope from and into the trolley so as to suitably adjust the distance between the trolley and the rope support. In this prior art, it is necessary to extend the rope connecting the trolley and the rope support along the girder. Therefore, this arrangement cannot be adopted in the crane of the type in which the structure is flexed at its intermediate portion. In addition, the smooth running of the trolley is impaired due to the necessity for towing the rope support.

SUMMARY OF THE INVENTION

Accordingly, an object of the invention is to provide a method of and apparatus for supporting a rope in a crane having a foldable elevation structure so as to prevent the rope from hanging from the structure thereby to ensure the safety and to permit an efficient cargo handling without being interfered by the rope supporting means.

Another object of the invention is to permit a prompt folding of the elevation structure while attaining the first-mentioned object.

To these ends, according to one aspect of the invention, there is provided a method of supporting a rope in a crane, the crane having an elevation structure foldable at its intermediate portion, the rope extending along the structure, and a rope support for supporting the rope, the method being characterized in that, when the structure is folded and elevated, the rope support is shifted to and held at a position in the vicinity of point of folding, whereas, when the elevation structure is straightened and lowered, the rope support is shifted to and held at a position near the extreme end of the structure.

According to another aspect of the invention, there is provided, in a crane having an elevation structure foldable at its intermediate portion, a rope extended along the structure and a rope support for supporting the rope, a rope supporting apparatus characterized by comprising: means for mounting the rope support on the structure for movement along the structure; and a shifting driving means provided for the rope support.

DESCRIPTION OF THE PREFERRED EMBODIMENTS

Figure 1:
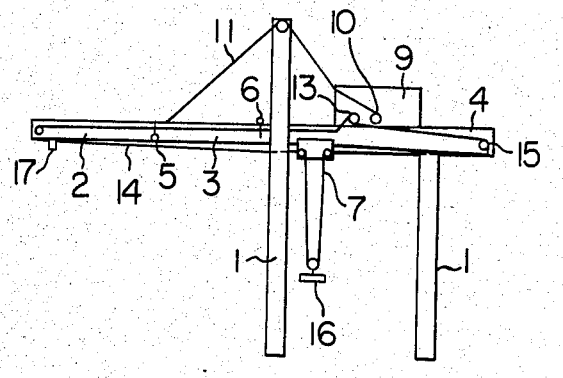
FIG. 1 is a side elevational view of the whole portion of a crane in accordance with the invention.
Figure 2:
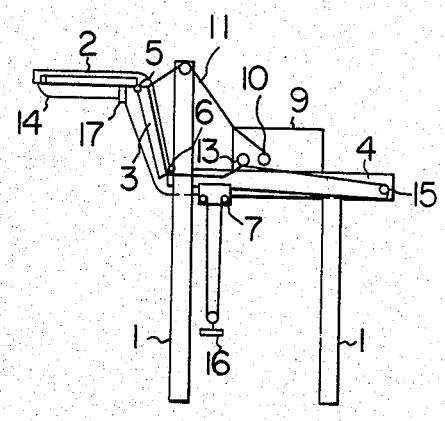
FIG. 2 is a side elevational view of the crane shown in FIG. 1 in a state in which the structure is folded.
Figure 3:
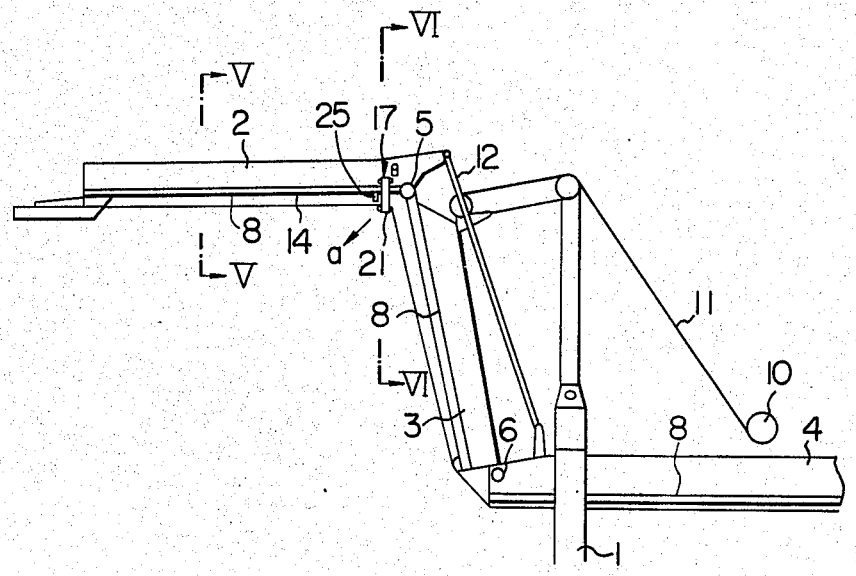
FIG. 3 is an enlarged perspective view of an essential part of the crane in the state shown in FIG. 2.

Referring first to FIGS. 1 and 2, a bridge crane has a series of structures supported by tall legs or supports 1. The crane is constituted by an end boom section 2, a base boom section 3 and a main girder section 4. Each of these sections is pivotally connected to its adjacent one or ones through shafts for pivotal movements in a vertical plane. As shown in FIG. 3, a rail 8 is laid over the boom sections 2, 3 and 4, along which a cargo trolley 7 runs. The main girder section 4 carries a machine room 9 having an elevation winch 10 from which an elevation rope 11 is extended. The end of the rope 11 is connected to the base boom section 3 so that the girder is folded or flexed at a plurality of points as illustrated in FIG. 2 and FIG. 3. In order to hold the end boom section 2 substantially horizontal in the folded condition, a link 12 is connected between the main girder 4 and the end boom section 2. The link 12 serves to keep the end boom section 12 in horizontal posture during raising and lowering of the same.

A hoisting rope 14 is extended from a hoisting winch 13 mounted also in the machine room 9. The rope 14 goes round a rope sheave 15 on the extreme end of the main girder section 4 and then extends past the cargo trolley 7 and returns to the same through a hoist tackle 16. The end of this rope is connected to the top end of the end boom section 2.

Thus, the hoisting rope 14 is extended along the series of each boom and main girder sections and, as the hoisting rope 14 is pulled and slacked by the hoisting winch 13, the hoist tackle 16 is moved up and down while the trolley 7 runs along the rail 8 over each of the series of sections, thereby to transfer the cargo.

Figure 4:
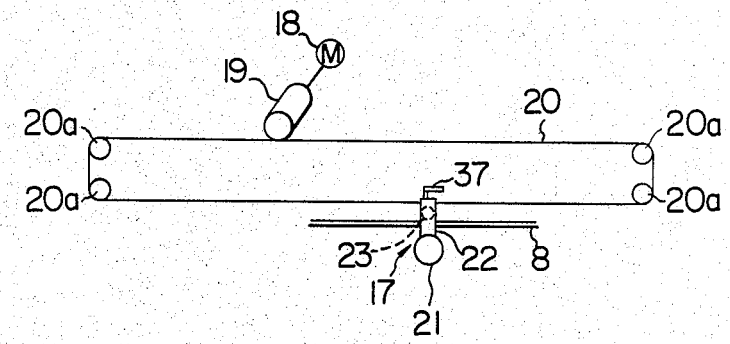
FIG. 4 is a schematic illustration of a means for shifting a rope support as shown in FIG. 2.

The rail 8 on the end boom section 2 carries also a rope support 17 adapted to run therealong. As will be seen from FIG. 4, a rope 20 extended in both directions from a drum 19 driven by an electric motor 18 is connected to the rope support 17 after making a turn around a rope sheave 20*a*. The arrangement is such that, as the drum 19 rotates, the rope 20 at one side of the drum 19 is taken up while the rope at the other side is released to cause a movement of the rope support. As will be seen from FIG. 5, the motor 18 and the drum 19, as well as the rope sheave 20*a*, are secured to the end boom section 2. Obviously, the rope support 17 can be moved in the opposite direction by a reversing of the motor 18.

Figure 5:
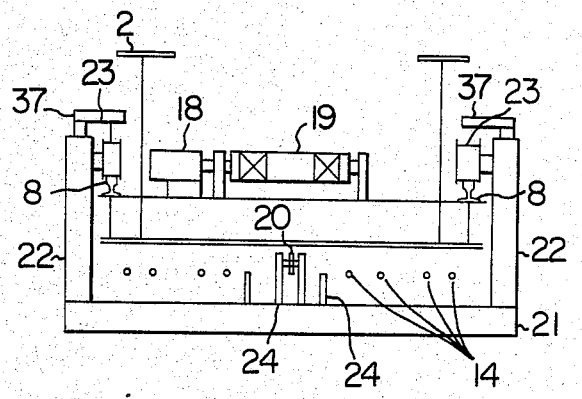
FIG. 5 is a view taken along the line V—V of FIG. 3.

As will be best seen from FIG. 5, the rope support 17 has a support rod 21 disposed beneath the hoisting rope 14, brackets 22 vertically secured to the support rod 21, and wheels 23 attached to the brackets 22 and adapted to run along the rails extended at both sides of the end boom section 2. In order to prevent any lateral deviation of the hoisting rope 14, vertical support plates 24 are secured to the upper surface of the support rod 21. The upper ends of the brackets 22 are projected inwardly, i.e. towards each other, to serve as strikers 37. It will be seen from FIG. 3 that the point for support of the hoisting rope 14 is positioned at the lower side of the end boom section 2, adjacent to the pivot shaft 5 through which the end boom section 2 is connected to the base boom section 3.

Figure 6:
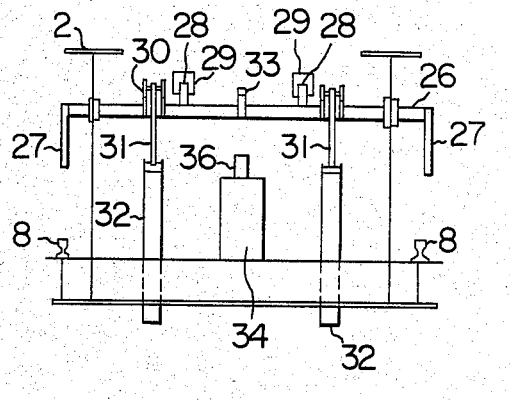
FIG. 6 is a view taken along the line VI—VI of FIG. 3.
Figure 7:
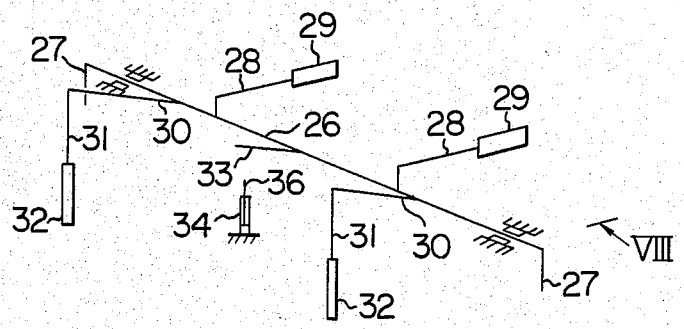
FIG. 7 is a skelton perspective view of a stopper device shown in FIG. 3 in an inoperative state.
Figure 8:
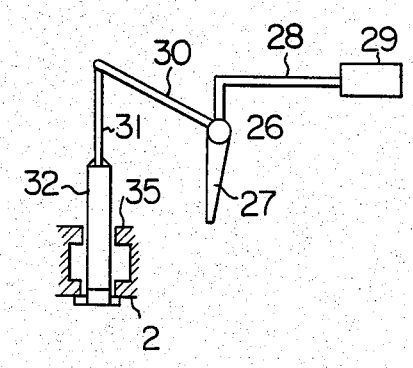
FIG. 8 is a view of the device shown in FIG. 7 as viewed in the direction of arrow VIII in FIG. 7.
Figure 9:
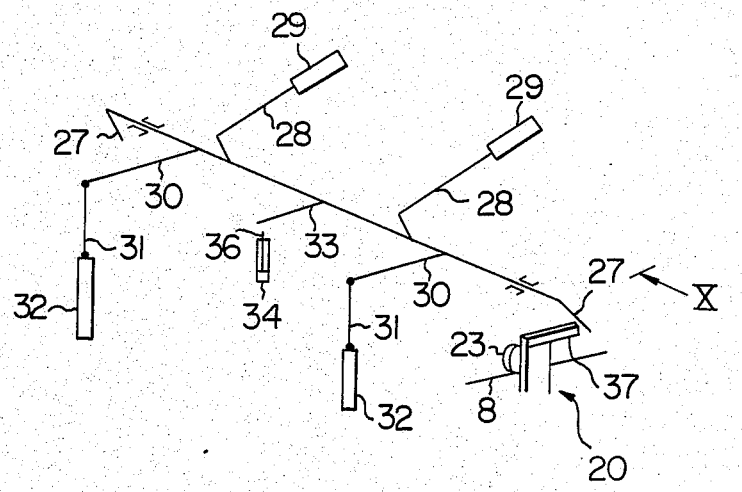
FIG. 9 is a skelton perspective view of the stopper device shown in FIG. 3 in operative state.

The end boom section 2 is provided at its portion adjacent to the support point with a stopper device 25. As shown in FIGS. 6, 7 and 8, the stopper device 25 is constituted by a rotary shaft 26 rotatably carried by a side plates of the end boom section 2 through bearings, levers 27 attached to both ends of the rotary shaft 26, arms 28 secured to the rotary shaft 26 and bent at a right angle at their intermediate portions, balance weights 29 attached to the ends of the arm 28, arm 30 secured to the rotary shaft 26 and extending in the opposite direction to the arm 28, links 31 rockably secured to the arm 30, stoppers 32 rockably secured to the lower ends of the links 31, an arm 33 attached to the mid portion of the rotary shaft 26, and a support lifter 34 secured to the end boom section 2 and having an extendable and retractable end 36 opposing the end of the arm 33. The stopper 32 is a vertical rod having an end which is extended through a vertical guide hole 35 formed in the end boom section 2 for free up and downward motion therein.

The first embodiment of the rope supporting apparatus of the invention, having the construction described hereinbefore, operates in a manner explained hereinunder.

During the operation of the crane, the cargo trolley 7 suspending a cargo at its hoisting tackle 16 runs along the rail 8 over the each of the boom sections 2, 3 and the main girder 4. In this state, needless to say, the boom sections 2 and 3 are straightened with respect to one another to form a horizontal line continuous with the main girder section 4. As the motor 18 is operated to rotate the drum 19 to take up or pay off the rope 20, the rope support 17 is moved along the rail 8 to the extreme end of the end boom section 2 as the wheels 23 roll along the rails 8. The motor 18 is stopped in this state to remove the rope support 17 from the working span of the trolley 7. In consequence, the mutual interference between the trolley 7 and the rope support 17 or between the portion of the rope 14 hanging from the trolley 7 and the rope support 17 is avoided to preserve an ample space for the cargo handling work.

The elevation structure of the crane, i.e. the boom sections 2 and 3, are folded when it is desired to clear the tall masts of a cargo boat or when it is necessary to suspend the work for other reason. This can be done in the same manner as the conventional crane by taking up the elevation rope 11 by means of the elevation winch 10. Namely, by so doing, the boom sections 2 and 3 are each elevated and swung around the pivot shafts 5 and 6 to take a posture as shown in FIGS. 2 and 3.

Figure 10:
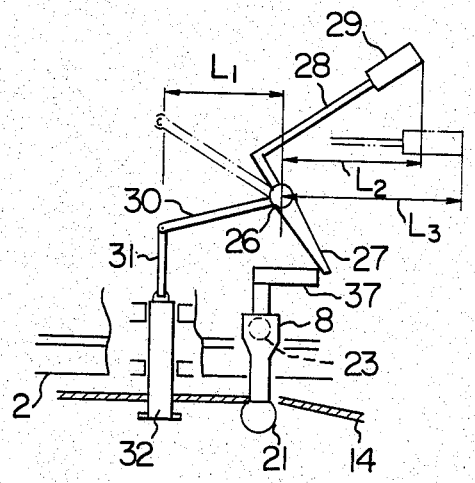
FIG. 10 is a view of the stopper device as viewed in the direction of arrow X in FIG. 9.

In bending the girder, the motor 18 is reversed to drive the drum 19 in the counter direction after shifting the trolley 7 to the main girder 4. By so doing, the rope 20 is operated to make the rope support 17 run along the rail 8 to the support point mentioned before. As the rope support 17 reaches the support point, the strikers 37 push the levers 27 to cause the rotary shaft 26 to rotate. In consequence, the stoppers 32 are projected as shown in FIG. 10 to the lower side of the end boom section 2 to take a level where they oppose the rope support 17.

In consequence, the arm 30 and the arm 28 are moved from the position shown by two-dot-and-dash line to the position shown by full line, but the length $L_1$ of the arm of the moment acting on the arm 30 around the rotary shaft 26 is not changed substantially. However, the length of the arm of the moment acting on the arm 28 carrying the balance weight 29 around the rotary shaft 28 is decreased from $L_2$ to $L_3$. Normally, however, the arm 28 is held horizontal to produce the maximum moment arm length $L_2$ to attain a large clockwise moment around the rotary shaft 26 so that the stopper 32 is held at an elevated position without the aid of any power. However, after the stopper 32 is projected downwardly, the moment arm length of the moment acting on the arm 28 is decreased whereas no substantial change is caused in the length of moment arm on the arm 30, so that the counter-clockwise moment overcomes the clockwise moment to hold the stopper 32 at the projected position without requiring any power. Once this state is attained, the hoisting ropes 14 are supported by the support rod 21 and, hence, never hang from the girder even when the latter is folded or flexed. The rope support 17 in support of the hoisting rope 14 bears a force which acts in the direction of an arrow a in FIG. 3. This force has a horizontal component which acts to urge the rope support 17 to the left. This movement, however, is prevented by the provision of the stopper 32 which stops the rope support 17, so that the hoisting rope 14 can be supported securely.

For dismissing the rope support, the extendable and retractable end 36 of the support lifter 34 is extended to push up the projected end of the arm 33. As a result, the rotary shaft 26 is reversed to move the stopper 32 to a level where it can clear the rope support 17 and to hold the same at this position. The force for holding the stopper 32 at this position is produced without requiring any specific power, by the clockwise moment around the rotary shaft 26 generated by the moment arm $L_3$ and the weight of the balance weight 29. Thereafter, the rope support 17 is shifted to the extreme end of the end boom section 2 thereby to release the rope from the support. Since the motor 18 is a D.C. electric motor, it is possible to control the motor 18 easily and to prevent accidental impact on the levers 27 by the strikers 37.

As will be understood from the foregoing description, the first embodiment of the invention offers the following advantages. Namely, it is possible to support the hoisting rope 14 at the support point without fail, through cooperation between the stopper 32 and the rope support 17. In addition, it is possible to obtain a sufficiently ample cargo handling service area because the rope support 17 is moved to a position where it does not hinder the movement of the trolley 7, in advance to the commencement of the cargo handling work. Furthermore, it is to be pointed out that the holding of the stoppers 32 at the elevated position and lowered position can be made without requiring any specific force. Namely, it suffices only to impart a force for pushing up the arm 33 for dismissing the stoppers 32, so that the power is saved advantageously.

Figure 15:
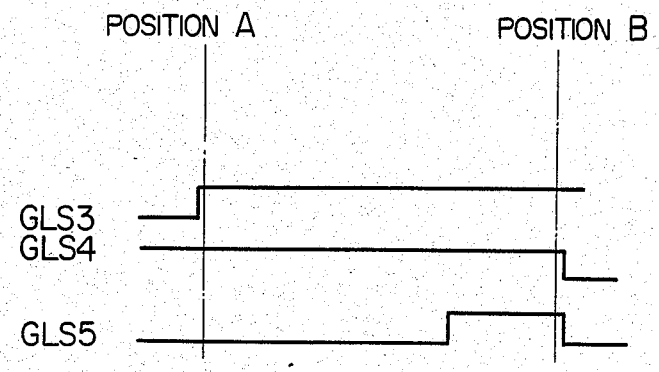
FIG. 15 is a chart showing operation of geared limit switches as shown in FIG. 12.
Figure 16:
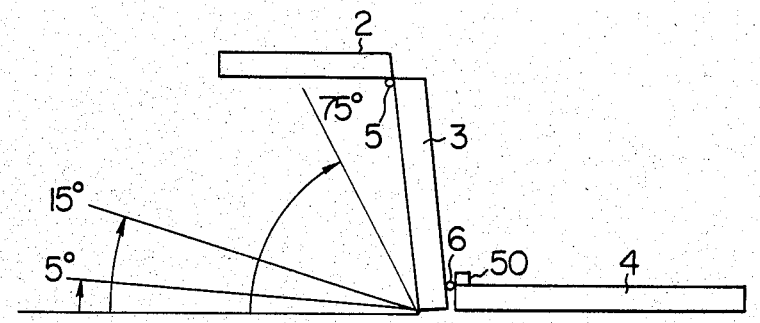
FIG. 16 is a diagram showing the elevation angle of the base boom section as shown in FIG. 11.

A second embodiment of the invention will be described hereinunder. The same reference numerals are used to denote the parts or members which are the same as those in the first embodiment. The second embodiment has the following features besides the features of the first embodiment. Namely, in the second embodiment, the bracket 22 of the rope support 17 has strikers 38 and 39 projected from both sides thereof as will be seen from FIG. 11. The end boom section 2 is provided at its portions corresponding to the ends of stroke of the rope support 17 with limit switches 40 (contact RS1) and 41 (contact RS2) disposed at the same level as the strikers 38 and 39, as will be seen from FIG. 11. The end boom section 2 is provided also with a limit switch 42 having a switch lever opposing the lever 27. A geared limit switch 50 serving as a rotation angle detector is attached to the pivot shaft 6 of the base boom section 3 as will be seen from FIG. 16. The geared limit switch 50 has contacts GLS6, GLS7 and GLS8 which are set to operate at rotation angles of, for example, 5°, 15° and 75°, respectively, although such angles are not exclusive. More specifically, the contacts GLS6 and GLS7 open as the rotation angle exceeds 5° and 15°, respectively, while the contact GLS8 closes as the rotation angle exceeds 75°. As will be seen from FIG. 12, a brake 43 is attached to the rotor shaft end of the electric motor 18 adjacent to the drum 19, while a geared limit switch 44 is connected to the opposite end of the rotor shaft of the motor 18. The geared limit switch 44 has contacts GLS3, GLS4 and GLS5 which operate in accordance with an operation timing chart as shown in FIG. 15.

Figure 13:
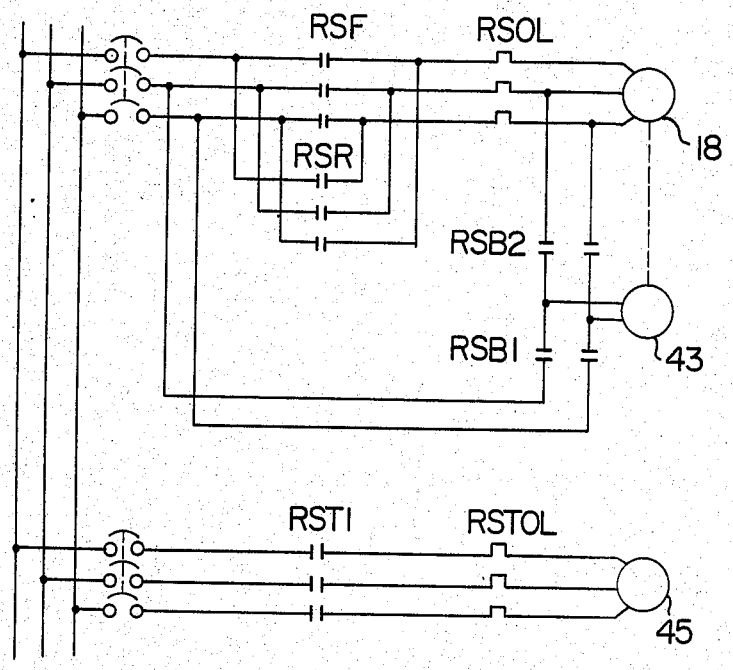
FIG. 13 is a circuit diagram of a power supply circuit for the motors and brakes of the arrangements shown in FIGS. 1 and 12.

As shown in FIG. 13, the electric circuit for the motor 18 has a forward operation relay RSF and a reverse operation relay RSR which are connected between the power supply and the motor 18. The brake device 43 of the motor 18 is adapted to become inoperative when either one of the relays RSB1 and RSB2 is energized but produces a braking force when both of these relays are de-energized.

As shown in FIG. 13, the motor 45 for extending and retracting the support lifter 24 is connected to the power supply through a relay RST. These equipments are operated and controlled by a circuit, the construction and operation of which will be explained hereinunder with specific reference to FIG. 14. The control is made through various buttons mounted on a control box mounted on a main grider 4, such as a stop push button 4PB, rope support forward push button 1PB, rope support backward push button 2PB, test button 3PB for motor 45 of the support lifter 24 and so forth.

As in the case of the first embodiment, the vertical movement of the stopper 32 is effected in connection with the arrival of the rope support 17 at the rope support point. Thus, no specific electric control is made for the lowering of the stopper 32.

In this second embodiment, as the lever 27 is rotated upon contact with the striker 37 of the rope support 17, the stopper 32 is projected to the lower side as in the case of the first embodiment. Simultaneously, the lever 27 leaves the limit switch 42 so that the contact RLS1 of the limit switch 42 is opened. This contact of the limit switch 42 is incorporated in the control condition circuit for the operation of the motor 18 to realize a sequence control.

In operation of the second embodiment, as the elevation rope is taken up by the elevation winch, the base boom section is swung upward around the rotary shaft 6 from the horizontal position, by an angle proportional to the amount of take-up of the rope. At the same time, the elevation structure consisting of the end boom section 2 and the base boom section 3 starts to be flexed at the pivotal connection between these sections 2 and 3. The shaft 6 is also rotated in accordance with the rotation of the base boom section 3, and the rotation of the shaft 6 is transmitted to the geared limit switch 50. The operation of the elevation winch turns on the contacts BH and BFDR because these contacts are operated through contact with, for example, the manipulation lever of the elevation winch. In the initial period of upward swinging of the base boom section in which the rotation angle is still less than 5°, the contacts GLS6 and GLS7 are held in an on state, while the contact GLS8 is in an off state. The relays R7 and R8 are therefore energized while the relay R9 is not energized. In addition, the rope support 17 is still in the position A shown in FIG. 11 so that the lever 27 is in contact with the limit switch 42 to keep the contact LS1 on and, hence, to keep the relay R5 energized. In the geared limit switch 44, the contacts GLS4 and GLS5 are in on state, while the contact GLS3 is in off state, because the rope support 17 takes the position A. Therefore, the relay R3 is not energized whereas the relays R4 and R6 are energized. In consequence, the relay RSR continues to be energized by the self-maintaining function of this relay. Since the relays RSR and RSB2 are energized, the motor 18 is allowed to operate while the brake device 43 is kept inoperative, so that the rope support 17 is moved towards the pivot shaft 5. As the rotation angle of the base boom section is increased beyond 5°, the contact GLS6 is turned off to de-energize the relay R7 but the relay RSR continues to be energized by its self-maintaining function so that the rope support 17 goes on to run.

Figure 11:
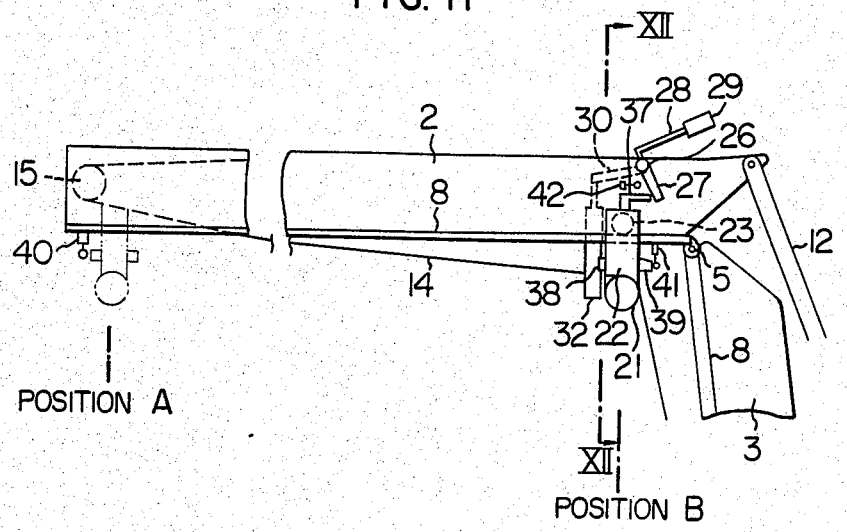
FIG. 11 is an elevational view of an end boom section in a second embodiment of the invention, in the state after folding.
Figure 12:
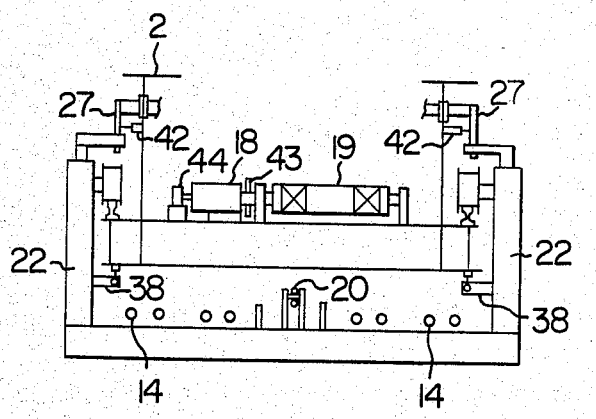
FIG. 12 is a schematic illustration taken along the line XII—XII of FIG. 11.

As the rope support 17 reaches a position B shown in FIG. 11 before the angle of rotation of the base boom section 3 grows to 15°, the striker 39 strikes the limit switch 41 so that the contact RS2 is turned off to de-energize the relay R4. This in turn de-energizes the relay RSR to stop the motor 18. In consequence, the rope support 17 makes a stop at the position B so as to support the rope 14 in the vicinity of the pivot shaft 5 thereby to prevent the slack of rope 14.

As the rope support 17 arrives at the position B, the stopper 32 is lowered as in the case of the first embodiment. As the base boom section 3 is further swung upwardly beyond the rotation angle of 15°, the contact GLS7 is turned off to de-energize the relay R8. In consequence, the relay RSB1 is energized so that the brake device 43 becomes inoperative. This state is maintained until the angle of upward rotation of the base boom section 3 exceeds 75°. As the base boom section 3 is swung upward beyond 75°, the contact GLS8 is turned off and the relay R9 is de-energized to stop the elevation winch. Namely, the crane has such an interlocking circuit which employs the de-energization of the relay 9 as a condition for stopping the elevation winch. The contact BFDR is turned off simultaneously with the stopping of the elevation winch thereby to de-energize the relays RSB1 and RSB2. In consequence, the brake device 43 produces a braking force to stop the rope support 17 without fail. The hoisting rope 14 forces back the rope support 17 towards the stopper 32 before the braking device 43 produces a braking force, so that the rope support 17 is stopped in contact with the stopper 32. It will be understood that this stopping mechanism protects the braking device 43 and the rope 20 from excessive force. In addition, the cooperation between the braking device 43 and the stopper 32 ensures the stopping and holding of the rope support 17 at the correct position even if there is a slip in the braking device 43, so that the hoisting rope 14 can be supported securely without any slack.

The downward rotation of the base boom section 3 is initiated by pushing of the contact 1PB to the on position. In the case where the base boom section 3 has been swung to the upper limit of the swinging stroke, i.e. to the rotation angle of 75°, the rope support 17 takes a position B shown in FIG. 11, so that the contact GLS3 is kept on as well as the contact RS1. As a result, the relay R3 is energized to permit the energization of the relay RSFR, which in turn initiates the self-maintaining function of this relay RSFR. In consequence, the relay RSFR continues to be energized even if the contact 1PB is relieved from the pushing force. In addition, since the rope support 17 takes the position B in FIG. 11, the contact GLS5 is in off state and the rotation angle of the base boom section 3 exceeds 5°, so that the contact GLS6 is in off state. Therefore, the relays R6 and R7 are not energized, and the motor 18 and the motor 45 for operating the lifter 24 are not at work.

As the downward swinging of the base boom section 3 is continued to decrease the rotation angle below 5°, the contact GLS6 is turned on to energize the relay R7. In this state, the relay RST is energized for the first time. Since the relay R8 has been energized due to on state of the contact GLS7 because the rotation angle of the base boom section 3 is less than 15°, both of the relays RSB2 and the relay RST are energized to put the brake device into inoperative state. Then, the motor 45 starts to operate to cause an extending operation of the lifter 24 thereby to raise the lever 33 and, hence, the stopper 32. The upward movement of the stopper 32 causes a rotation of the lever 27 into contact with the limit switch 42 thereby to turn the contact RLS1 on, so that the relay RSF is energized. As a result of energization of the relay RSF, the motor 18 is reversed to make the rope support 17 move backwardly to the position A shown in FIG. 11. As the rope support 17 arrives at the position A, the contact GLS3 is turned off and, in addition, the striker 38 strikes the limit switch 40 to turn the contact RS1 off, so that the relay R3 is de-energized, thereby to stop the motor 18. In consequence, the rope support 18 is made to stop at the position A. The rope support 17 stopping at the position A does not contact with the hoisting rope 14 and, hence, does not hinder the movement of the hoisting rope 14.

As has been described, in the second embodiment of the invention, the rope support 17 is moved automatically so that the operator is relieved from the trouble of making specific operation for shifting the rope support 17. In addition, since the automatic shifting of the rope support 17 is made in connection with the folding at the juncture between the each boom sections 2 and 3, the folding can be completed in a short period of time without permitting the hoisting rope 14 to slack.

Figure 14:
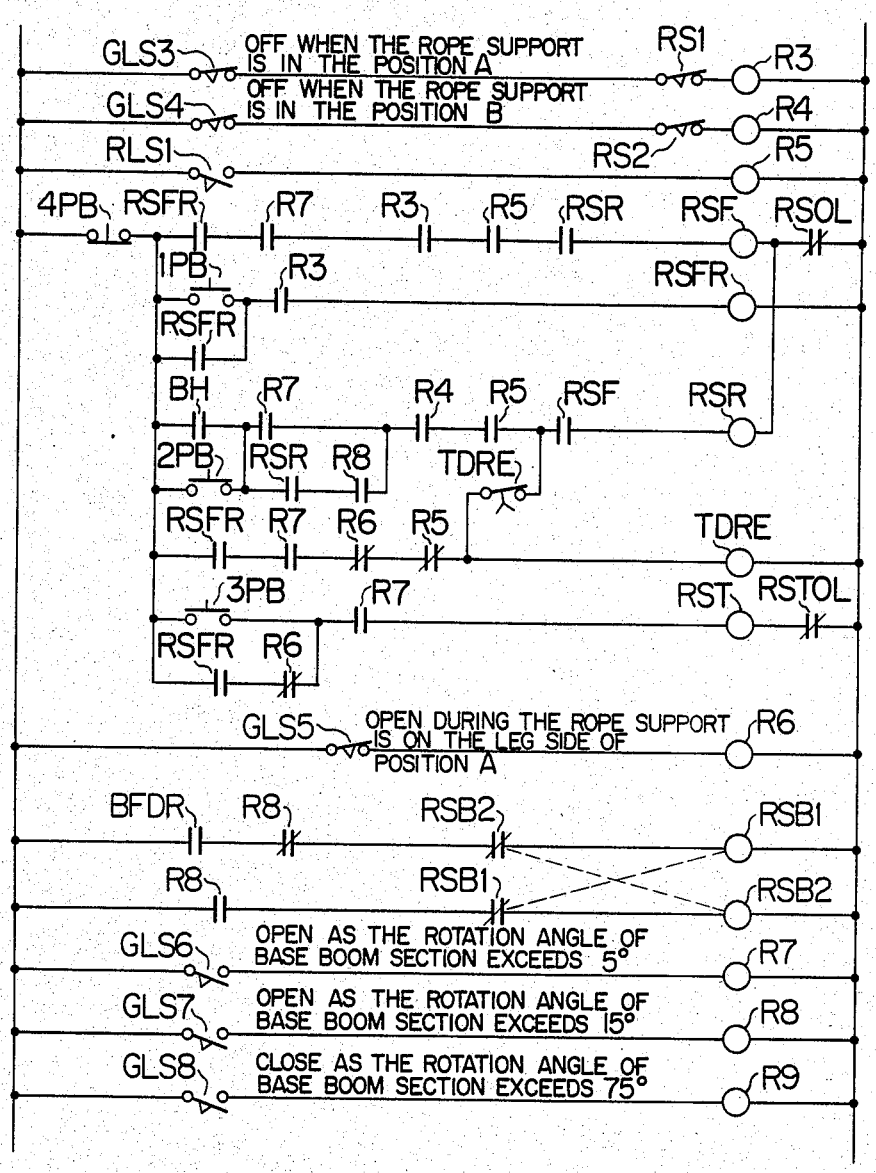
FIG. 14 is a circuit diagram of the equipments shown in FIGS. 11 and 12.

Furthermore, in the second embodiment of the invention, the control circuit as shown in FIG. 14 is equipped with push button switches 2PB, 3PB and 4PB. As the switch 2PB is pushed to on state, the motor 18 is started regardless of the state of the contact BH so that the rope support 17 is retracted from the position where it contacts with the stopper 32 towards the pivot shaft 5. It is often experienced that the stopper 32 can hardly be moved upward due to a too strong or sticking contact by the rope support 17. This problem, however, is overcome by the second embodiment because, in the second embodiment, it is possible to move the rope support 17 from the stopper 32 to permit an easy lifting of the latter. It is also possible to lift the stopper 32 irrespective of the states of the relays RSFR and R6, by energizing the relay RST through pushing the switch 3PB. It is thus possible to lift the stopper 32 as desired through a manual remote control by the combined use of the push button switches 2PB and 3PB. The push button switch 4PB serves as an emergency stop button. Namely, as this push button switch PB4 is pushed to off state, the relays RSF, RSFR, RSR, RST and a later-mentioned relay TDRE are all de-energized at once to stop all of the functions of the control circuit shown in FIG. 14 in case of energency, thereby to ensure the safety.

In the second embodiment, the control circuit shown in FIG. 14 is equipped with a safety circuit S.

More specifically, in the event that the stopper 32 is caught accidentally by the rope support 17 to become unable to move upward even after the base boom section is lowered down to a rotation angle below 5°, i.e. even after the energization of the relay RST, relays RSFR, R7, R6 and R5 in the safety circuit S are turned on so that a timer relay TDRE is energized and held in on state for a predetermined period of time to permit the energization of the relay RSR. In consequence, the motor 18 operates to shift the rope support 17 away from the stopper 32 for a predetermined period of time towards the pivot shaft 5. In consequence, the stopper 32 is allowed to safely move upwardly, without imposing an excessive load on the lifter 34.

In the described embodiment, the contacts in the geared limit switch 50 are set to operate at rotation angles of 5°, 15° and 75°. The angle values 5° and 15°, however, may be altered in accordance with the degree of slack of the rope 14. Thus, the setting of these angles is preferably made to avoid any danger which may be caused by the slack of the rope, through confirmation of amount of slack of the rope 14 in relation to the rotation or elevation angle of the base boom section 3. In the described embodiment, these angles are selected so that the rope support is completed before the rotation or elevation angle is increased to 15° and that the rope 14 is released from the support when the rotation or elevation angle is reduced to 5°.

Although the invention has been described through specific terms, it is to be noted here that the described embodiments are not exclusive and various changes and modifications may be imparted thereto.

For instance, the geared limit switch 50, which is attached to the pivot shaft 6 in the second embodiment, may be connected in torque-transmitting relation to the shaft of the elevation winch. In such a case, the rotation or elevation angle of the base boom section 3 is detected as the angle of rotation of the shaft of the elevation winch, because the latter is in proportion to the rotation or elevation angle. It is also possible to employ, as a system for shifting the rope support 17, a rack-and-pinion type driving device or a driving device having a motor for directly driving the wheels 23 of the rope support. The electric control circuit shown in FIG. 14 may be substituted by, for example, a computer having functions equivalent to those of the electric circuit.

Further changes and modifications are still possible without departing from the scope of the invention which is limited solely by the appended claims.

What is claimed is:

1. A method of supporting a rope in a crane, said crane having a structure along which a trolley having a hoisting tackle suspended therefrom runs, said structure comprising a girder supported horizontally, a base boom and an end boom which are pivotably connected in series with each other at their opposing ends, so that said base boom is foldable relatively to said girder and end boom for elevation movement while said end boom is held substantially in horizontal posture, and a hoisting rope extended along said structure for suspending said tackle while being supported at the opposite ends of said structure, said method being characterized in that when said base boom is straightened horizontally, a rope support provided for supporting said hoisting rope between the opposite ends of said structure is positioned at the free end of said end boom, whereas, when said base boom is elevated, said rope support is moved to and held at a position on said end boom in the vicinity of the end thereof pivotably connected to said base boom.

2. A method of supporting a rope according to claim 1, wherein when said base boom is folded and elevated, said rope support is moved to said position in the vicinity of the connected end of said end boom before the elevation angle reaches an angle at which said rope is slacked to hang by a dangerous amount, and is moved to the free end of said end boom after the commencement of lowering of said base boom when said elevation angle is decreased to such an angle where the amount of hang of said rope is not dangerous.

3. A rope supporting apparatus for a crane, said crane having a structure along which a trolley having a hoisting tackle suspended therefrom runs, said structure comprising a girder supported horizontally, a base boom and an end boom which are pivotably connected in series with each other at their opposing ends so that said base boom is foldable relatively to said girder and end boom for elevating movement while said end boom is held substantially in horizontal posture, and a hoisting rope extended along said structure for suspending said tackle while being supported at the opposite ends of said structure, said rope supporting apparatus comprising:

rope support means adapted to support said hoisting rope;

driving means for moving said rope support means on said end boom between the free end of said end boom and a position in the vicinity of the end of said end boom connected to said base boom; and means for controlling the driving of said rope support means by said driving means in response to a base boom elevation angle so that when said base boom is straightened horizontally, said rope support means is positioned at the free end of said end boom and when said base boom is elevated, said rope support means is moved to and held at said position in the vicinity of the connected end of said end boom.

4. A rope supporting apparatus according to claim 3, wherein said driving means includes a rope taking up device mounted on said structure and a towing rope extended from said rope taking up device and connected to said rope support means.

5. A rope supporting apparatus according to claim 3, further comprising first detecting means adapted to detect the elevation angle of said base boom, and said control means being adapted to control the driving of said rope support means by said driving means in accordance with the detection output delivered thereto by said first detecting means.

6. A rope supporting apparatus according to claim 5, wherein said first detecting means includes a rotation angle detector.

7. A rope supporting apparatus for a crane, said crane having a structure along which a trolley having a hoisting tackle suspended therefrom runs, said structure comprising a girder supported horizontally, a base boom and an end boom which are pivotably connected in series with each other at their opposing ends so that said base boom is foldable relatively to said girder and end boom for elevating movement while said end boom is held substantially in horizontal posture, and a hoisting rope extended along said structure for suspending said tackle while being supported at the opposite ends of said structure, said rope supporting apparatus comprising:

rope support means adapted to support said hoisting rope;

driving means for moving said rope support means on said end boom between the free end of said end boom and a position in the vicinity of the end of said end boom connected to said base boom;

means for controlling the driving of said rope support means by said driving means in response to a base boom elevation angle so that when said base boom is straightened horizontally, said rope support means is positioned at the free end of said end boom and when said base boom is elevated, said rope support means is moved to said position in the vicinity of the connected end of said end boom; and stopper means for holding said rope support means at said connected end position when said base boom is elevated, said stopper means including a rotary shaft mounted on said end boom at said connected end position thereof in the vicinity of said base boom and disposed to extend perpendicularly to a direction in which said rope support means is moved, at least one lever attached to said rotary shaft and adapted to be pushed by said rope support means so as to rotate said rotary shaft when said rope support means is moved to said connected end position, a first arm secured to said rotary shaft on the end boom free end side thereof to obliquely extend upward, a stopper suspended from said first arm and adapted to come into contact with said rope support means when said rotary shaft is rotated by said rope support means, and a second arm secured to said rotary shaft on the base boom side thereof to extend horizontally and having balance weights attached thereto.

* * * * *